US008540089B2

(12) United States Patent
Wang

(10) Patent No.: US 8,540,089 B2
(45) Date of Patent: Sep. 24, 2013

(54) HANGING CLOSET

(76) Inventor: Wen-Tsan Wang, Taipei (TW)

( * ) Notice: Subject to any disclaimer, the term of this patent is extended or adjusted under 35 U.S.C. 154(b) by 275 days.

(21) Appl. No.: 12/959,338

(22) Filed: Dec. 2, 2010

(65) Prior Publication Data

US 2012/0138556 A1 Jun. 7, 2012

(51) Int. Cl.
*A47F 7/19* (2006.01)
*A47G 25/18* (2006.01)
*A47G 25/54* (2006.01)

(52) U.S. Cl.
USPC ..... 211/118; 211/85.3

(58) Field of Classification Search
USPC ..... 211/118, 113, 117, 85.2, 85.3, 34–38, 211/10; 312/3–6; 206/278.1; 383/98; 150/110
See application file for complete search history.

(56) References Cited

U.S. PATENT DOCUMENTS 1,983,307 A * 12/1934 Regenhardt ..... 312/107
2,244,887 A * 6/1941 Manley ..... 312/6
2,410,700 A * 11/1946 Zalkind ..... 312/111
2,533,725 A * 12/1950 Eisenberg ..... 211/63
2,845,185 A * 7/1958 Winderweedle, Jr. ..... 108/164
3,669,276 A * 6/1972 Woods ..... 211/34
4,382,640 A * 5/1983 Kashden ..... 312/5
4,739,809 A * 4/1988 Adams ..... 150/112
5,125,519 A * 6/1992 Cambria ..... 211/118
5,542,758 A * 8/1996 Brown ..... 312/249.2
5,598,923 A * 2/1997 Owens ..... 206/370
5,779,033 A * 7/1998 Roegner ..... 206/6.1
5,957,310 A * 9/1999 Mitchell ..... 211/186
6,209,734 B1 * 4/2001 Wang ..... 211/87.01
6,318,822 B1 * 11/2001 Wang ..... 312/111
6,354,232 B1 * 3/2002 Hulke ..... 108/149
6,390,573 B1 * 5/2002 Wang ..... 312/6
6,719,157 B2 * 4/2004 Stoddart et al. ..... 211/118
6,732,659 B2 * 5/2004 Poon ..... 108/42
6,764,144 B2 * 7/2004 Insalaco et al. ..... 312/108
7,165,687 B1 * 1/2007 Stevens et al. ..... 211/86.01
7,258,232 B2 * 8/2007 Bradford et al. ..... 206/386
D566,986 S * 4/2008 Greiner ..... D6/411
D606,334 S * 12/2009 Clark et al. ..... D6/467
7,681,728 B2 * 3/2010 Sabounjian ..... 206/278.1
7,810,655 B2 * 10/2010 Wang ..... 211/118
7,954,639 B2 * 6/2011 Carney et al. ..... 206/579
8,033,405 B2 * 10/2011 Wang ..... 211/118
D651,830 S * 1/2012 Sabounjian ..... D6/514
2005/0140253 A1 * 6/2005 Fu ..... 312/6
2007/0131683 A1 * 6/2007 Sabounjian ..... 220/9.1
2007/0200470 A1 * 8/2007 Wang ..... 312/6
2011/0042335 A1 * 2/2011 McNicholas ..... 211/85.3

* cited by examiner

*Primary Examiner* — Jennifer E Novosad
(74) *Attorney, Agent, or Firm* — Leong C. Lei

(57) ABSTRACT

A hanging closet includes closet body having a plurality of horizontal panels arranged at different elevations to divide the inside space of the closet body into multiple compartments and a plurality of horizontal splits on one or both of the two opposing sidewalls, and compartment support members each having a first support panel and a third support panel respectively insertable through two adjacent horizontal splits of the closet body into the inside of the associating horizontal panels to give a support and a flexible connection pocket connected between the first and third support panels that can be stuffed with a second support panel.

5 Claims, 11 Drawing Sheets

HANGING CLOSET

BACKGROUND OF THE INVENTION a) Field of the Invention

The present invention relates to storage design technology and more particularly to a hanging closet for storing things, which facilitates mounting and dismounting, allows connection of multiple hanging closets.

b) Description of the Prior Art

Due to limited indoor house space in most families, wardrobe space in a house is limited; therefore, hanging closets are highly invited. A hanging closet can be hung on a high place or in a wardrobe to keep storage clothes and other accessories in a classified manner. Regular hanging closets are commonly made of canvass or any of a variety of tough and flexible sheet materials, having opposing top and bottom panels, opposing left and right panels and a back panel and defining therein a plurality of front-open type storage chambers for keeping things. A hanging closet further has a sleeve or Velcro tape provided at the top side for fastening to a hanging rod for hanging.

However, conventional hanging closets are commonly of a fixed design, not allowable for adjustment of the storage compartments to fit different requirements.

SUMMARY OF THE INVENTION

The present invention has been accomplished under the circumstances in view. It is the main object of the present invention to provide a hanging closet, which facilitates connection of multiple hanging closets in one of a variety of forms.

To achieve this and other objects of the present invention, a hanging closet comprises a closet body and a plurality of compartment support members. The closet body comprises opposing first side panel and second side panel, a back panel connected between said first side panel and said second side panel, a plurality of horizontal panels joined to the first side panel, the second side panel and the back panel at different elevations and dividing the inside space of the closet body into a plurality of front-open compartments. Each horizontal panel comprises an upper panel layer and a bottom panel layer. The upper panel layer and the bottom panel layer are partially and peripherally sealed together and defining an inside space in therebetween. Further, at least one of the first side panel and the second side panel have a plurality of horizontal splits disposed at different elevations and respectively kept in communication with the inside space of each of the horizontal panels. The compartment support members are adapted for supporting the horizontal panels of the closet body in shape. Each compartment support member comprises a first support panel insertable through one horizontal split of the closet body into the inside space of one of the horizontal panels, a third support panel insertable through one horizontal split of the closet body into the inside space of one of the horizontal panels, a flexible connection pocket connected between the first support panel and the third support panel and having an opening at one side thereof, two folding lines respectively connected between the first support panel and the third support panel and two opposing sides of the flexible connection pocket, a cover flap connected to one folding line and adapted for covering the opening of the flexible connection pocket, and a second support panel insertable through the opening of the flexible connection pocket into the inside of the flexible connection pocket.

Further, the first support panel and third support panel of each compartment support member are respectively inserted through one respective horizontal split of the closet bodies of two hanging closets of the same design into the associating horizontal panel of each of the two hanging closets to let the flexible connection pocket and second support panel of the compartment support member be horizontally suspending between the two hanging closets.

Further, the first support panel and third support panel of each compartment support member are respectively inserted through two adjacent horizontal splits of the closet body into the associating horizontal panels, and the flexible connection pocket and second support panel of the compartment support member are closely attached to one of the first side panel and the second side panel in vertical between the respective two adjacent horizontal splits.

Further, the upper panel layer and bottom panel layer of each horizontal panel of the closet body can be made of a flexible transparent sheet material.

In an alternate form of the present invention, the hanging closet comprises a closet body and a plurality of compartment support members. The closet body comprises opposing first side panel and second side panel, a back panel connected between the first side panel and the second side panel, a plurality of horizontal panels joined to the first side panel, the second side panel and the back panel at different elevations and dividing the inside space of the closet body into a plurality of front-open compartments. Further, at least one of the first side panel and the second side panel have a plurality of horizontal splits disposed at different elevations. The compartment support members are adapted for supporting the horizontal panels of the closet body in shape. Each compartment support member comprises a first support panel insertable through one horizontal split into the inside of the closet body to support one of the horizontal panels, a third support panel insertable through one horizontal split of the closet body into the inside of the closet body to support one of the horizontal panels, a third support panel connected between the first support panel and the third support panel, and two folding lines respectively connected between the first support panel and the third support panel and two opposing sides of the second support panel for enabling the second support panel to be biasable relative to the first support member and the second support member.

Further, each horizontal panel comprises an upper panel layer and a bottom panel layer. The upper panel layer and the bottom panel layer are partially and peripherally sealed together and defining an inside space in therebetween for receiving one of the first support panel and third support panel of one compartment support member.

DETAILED DESCRIPTION OF THE PREFERRED EMBODIMENT

Figure 1:
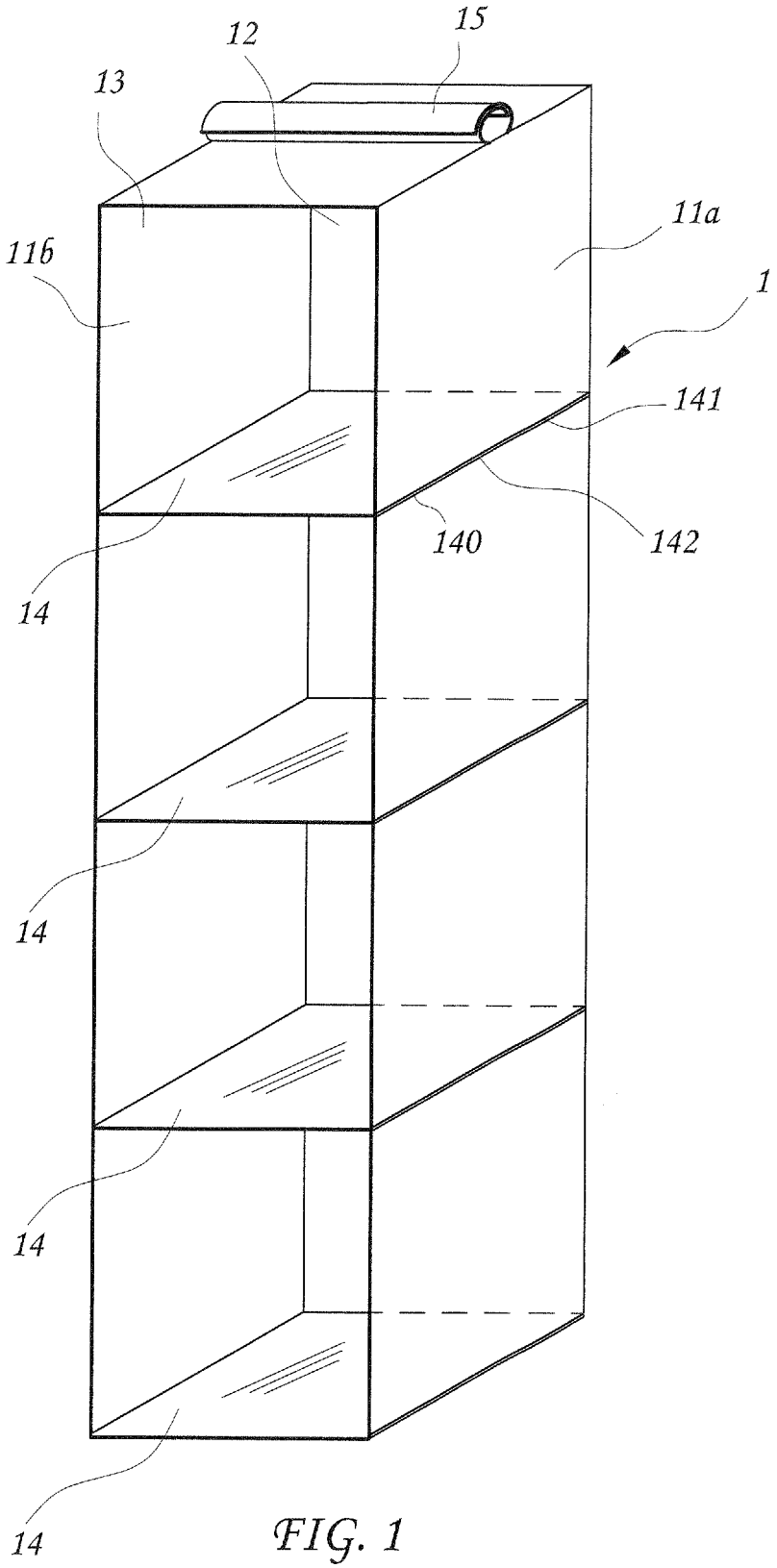
FIG. 1 is an elevational view of a closet body of a hanging closet in accordance with the present invention.
Figure 2:
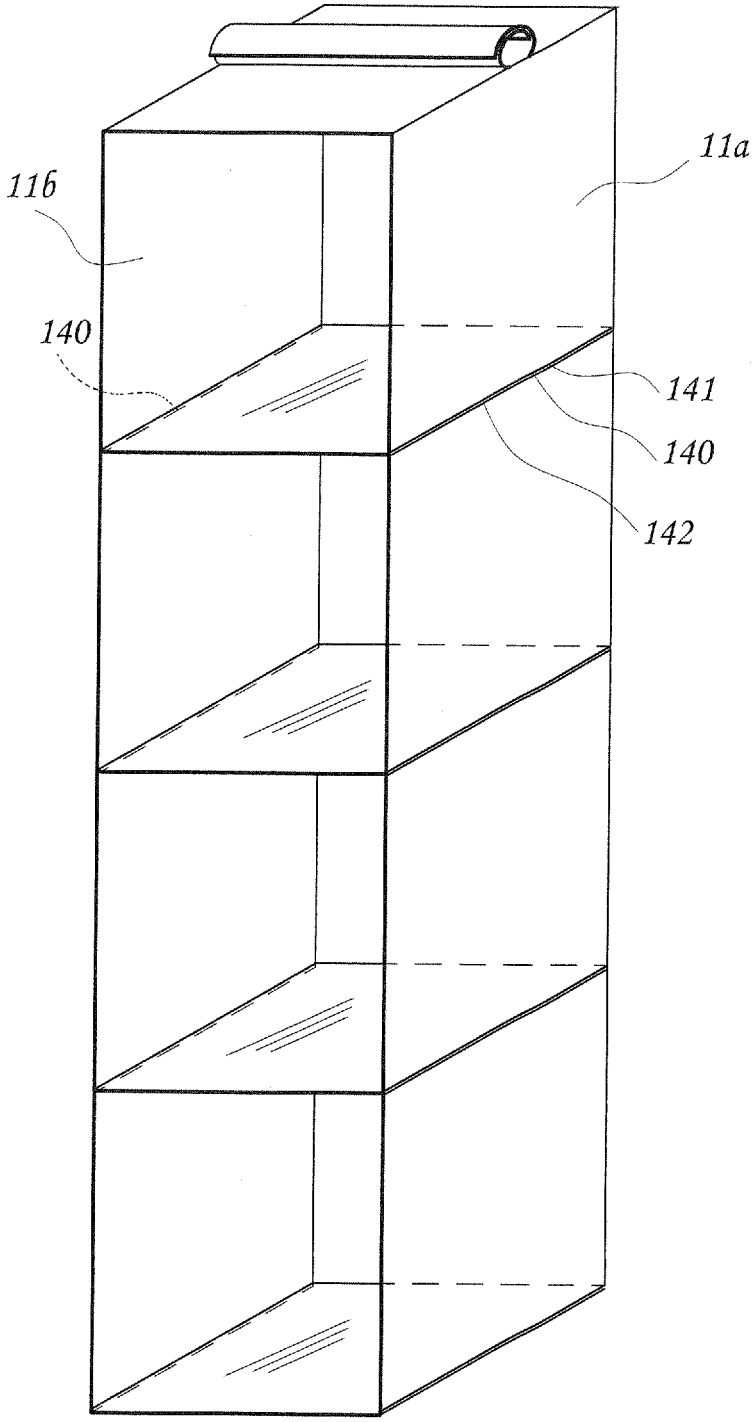
FIG. 2 is an elevational view of an alternate form of the closet body of the hanging closet in accordance with the present invention.
Figure 3:
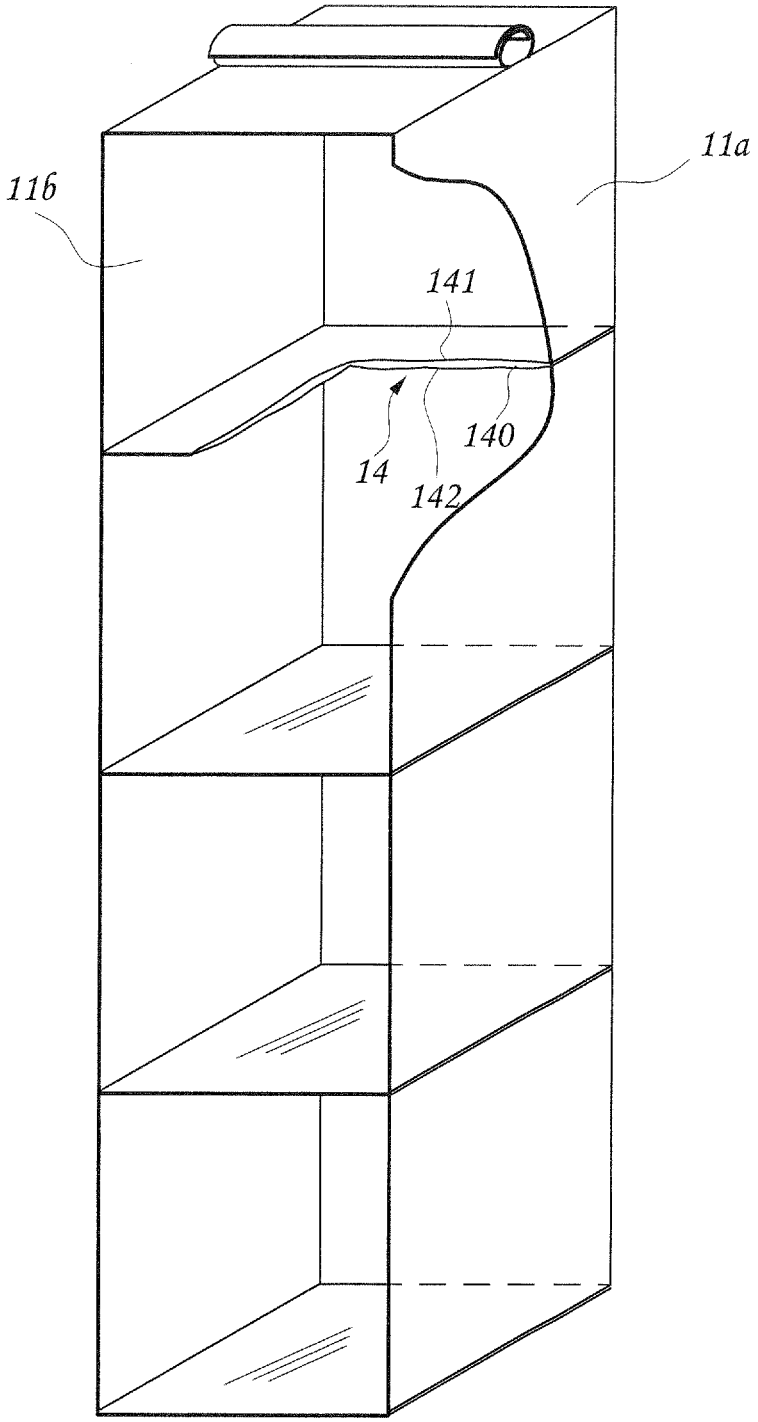
FIG. 3 is a cutaway view of the closet body of the hanging closet shown in FIG. 1.
Figure 4:
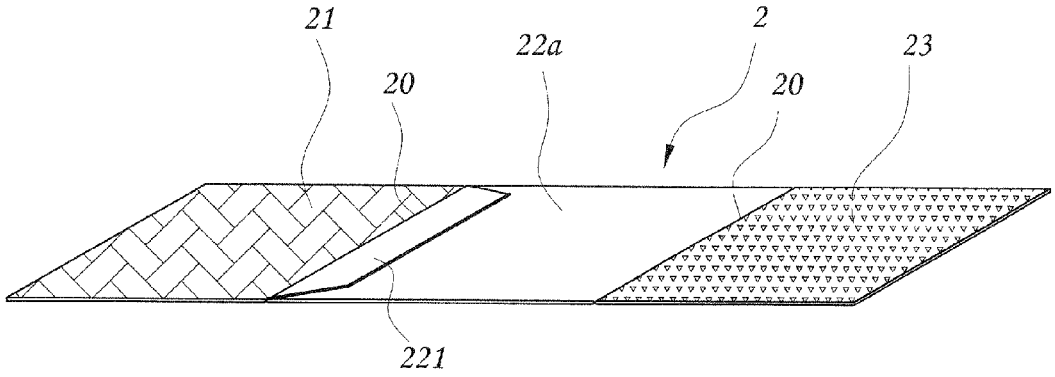
FIG. 4 illustrates an extended status of a compartment support member for hanging closet according to the present invention.

A hanging closet in accordance with the present invention is shown comprises a closet body 1 (see FIG. 1) and at least one compartment support member 2 (see FIG. 4). As shown in FIGS. 1~4, the closet body 1 in accordance with the present invention is made of a flexible sheet material, comprising opposing first side panel 11*a* and second side panel 11*b*, a back panel 12 connected between the first side panel 11*a* and the second side panel 11*b*, a plurality of horizontal panels 14 joined to the first side panel 11*a*, the second side panel 11*b* and the back panel 12 at different elevations and dividing the inside space of the closet body 1 into a plurality of rectangular front-open compartments 13. The horizontal panels 14 made in the shape of a flat rectangular pocket, each comprising a rectangular upper panel layer 141 and a rectangular bottom panel layer 142. The rectangular upper panel layer 141 and the rectangular bottom panel layer 142 can be made of a transparent or opaque flexible plastic sheet material. In one embodiment of the present invention, as shown in FIG. 1, the rectangular upper panel layer 141 and the rectangular bottom panel layer 142 have respective three of the respective four sides thereof sealed together and the respective other side left open with two of the sealed three sides respectively fixedly connected to the second side panel lib and back panel 12 of the closet body 1; the first side panel 11*a* has a plurality of horizontal splits 140 disposed at different elevations and respectively kept in communication with the inside space of each of the horizontal panels 14. In another embodiment of the present invention, as shown in FIG. 2, the rectangular upper panel layer 141 and the rectangular bottom panel layer 142 have respective two opposing sides thereof sealed together and the other two opposing sides left open with one of the sealed two opposing sides fixedly connected to the back panel 12 of the closet body 1; the first side panel 11*a* and the second side panel 11*b* each have a plurality of horizontal splits 140 disposed at different elevations and respectively kept in communication with the inside space (the two opposing open sides) of each of the horizontal panels 14.

Figure 5:
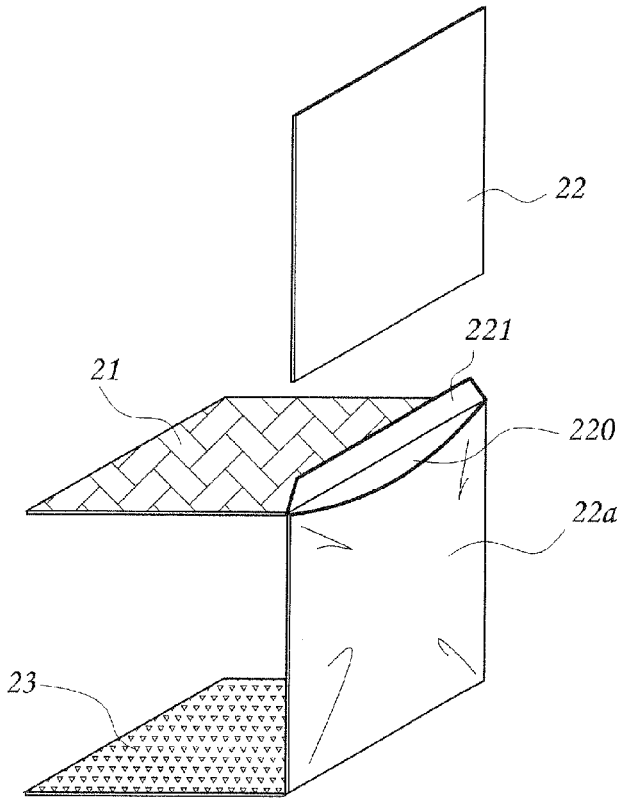
FIG. 5 is an exploded view of the compartment support member for hanging closet according to the present invention.

Referring to FIGS. 4 and 5, each compartment support member 2 comprises a first support panel 21, a third support panel 13, a flexible connection pocket 22*a* connected between the first support panel 21 and the third support panel 13 by a respective folding line 20, a cover flap 221 connected to one folding line 20 and adapted for covering the opening 220 of the flexible connection pocket 22*a*, and a second support panel 22 insertable through the opening 220 into the inside of the flexible connection pocket 22*a* to support the flexible connection pocket 22*a* in shape. The first support panel 21 and the third support panel 23 are approximately equal to the horizontal panels 14 of the closet body 1 in size, and respectively insertable through two adjacent splits 140 into the inside of two adjacent horizontal panels 14 of the closet body 1. The flexible connection pocket 22*a* have a width equal to the horizontal width of the first side panel 11*a* and second side panel 11*b* of the closet body 1, and a vertical height each to the vertical height between two adjacent horizontal splits 140 of the first side panel 11*a* or second side panel 11*b* of the closet body 1. Further, by means of the folding lines 20, the compartment support member 2 can be alternatively set between a flat condition shown in FIG. 4 and a ⊏-shaped configuration shown in FIG. 5.

Figure 6:
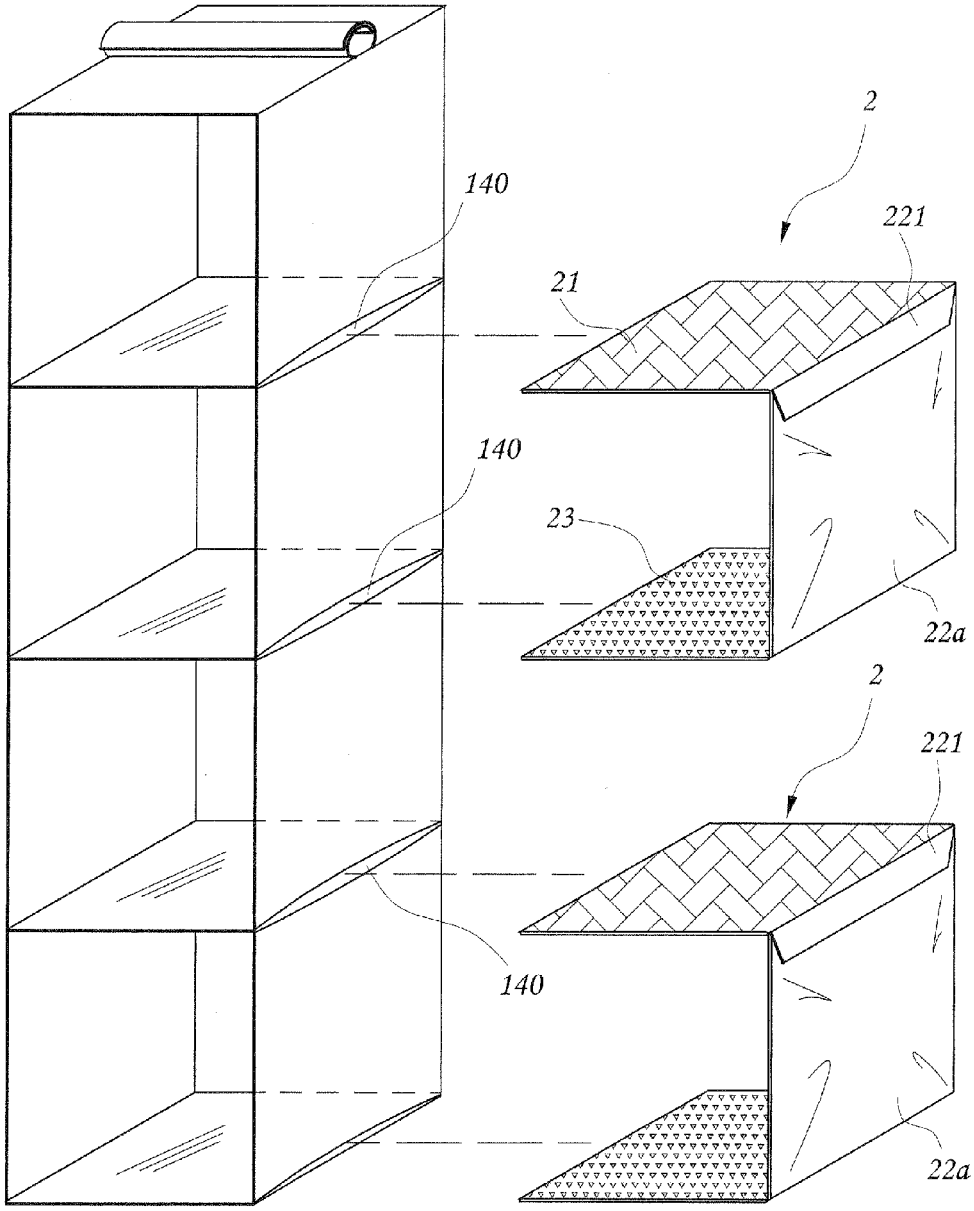
FIG. 6 is an exploded view of the present invention, illustrating one installation example of the compartment support members of the hanging closet.
Figure 7:
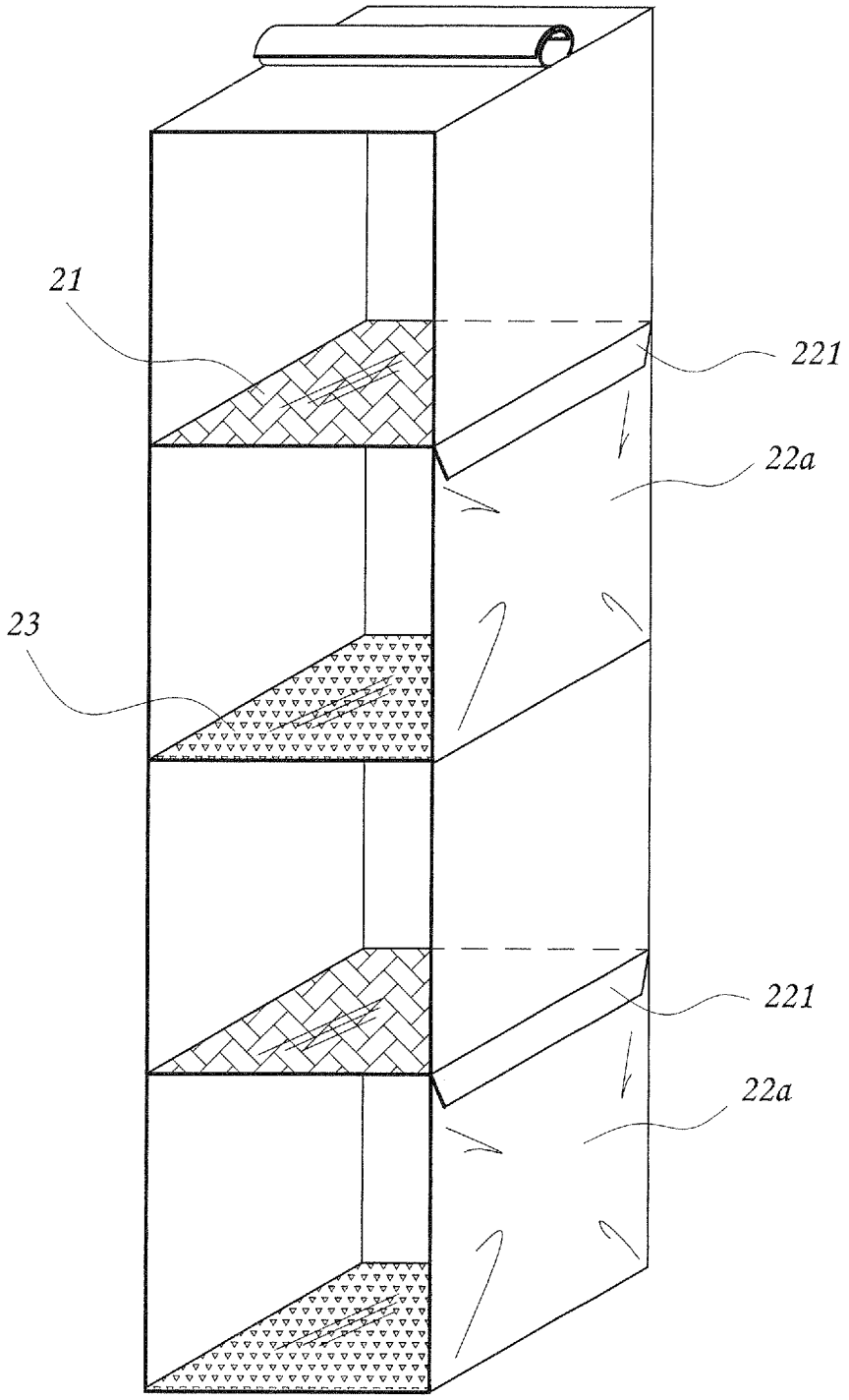
FIG. 7 corresponds to FIG. 6, showing the hanging closet installed.

Referring to FIGS. 6 and 7, compartment support members 2 are respectively arranged into a ⊏-shaped configuration, and then the first support panel 21 and third support panel 23 of each compartment support member 2 are respectively insertable through two adjacent splits 140 into the inside of two adjacent horizontal panels 14 of the closet body 1 to support the respective horizontal panels 14 in shape. Further, after removal of the second support panel 22 from the flexible connection pocket 22*a*, the flexible connection pocket 22*a* can be used for storing things. Further, the first support panel 21 and the third support panel 23 can be made carrying a respective design. Through the transparent the rectangular upper panel layers 141 and rectangular bottom panel layers 142 of each horizontal panels 14, the designs of the first support panels 21 and third support panels 23 of the installed compartment support members 2 are viewed.

Figure 8:
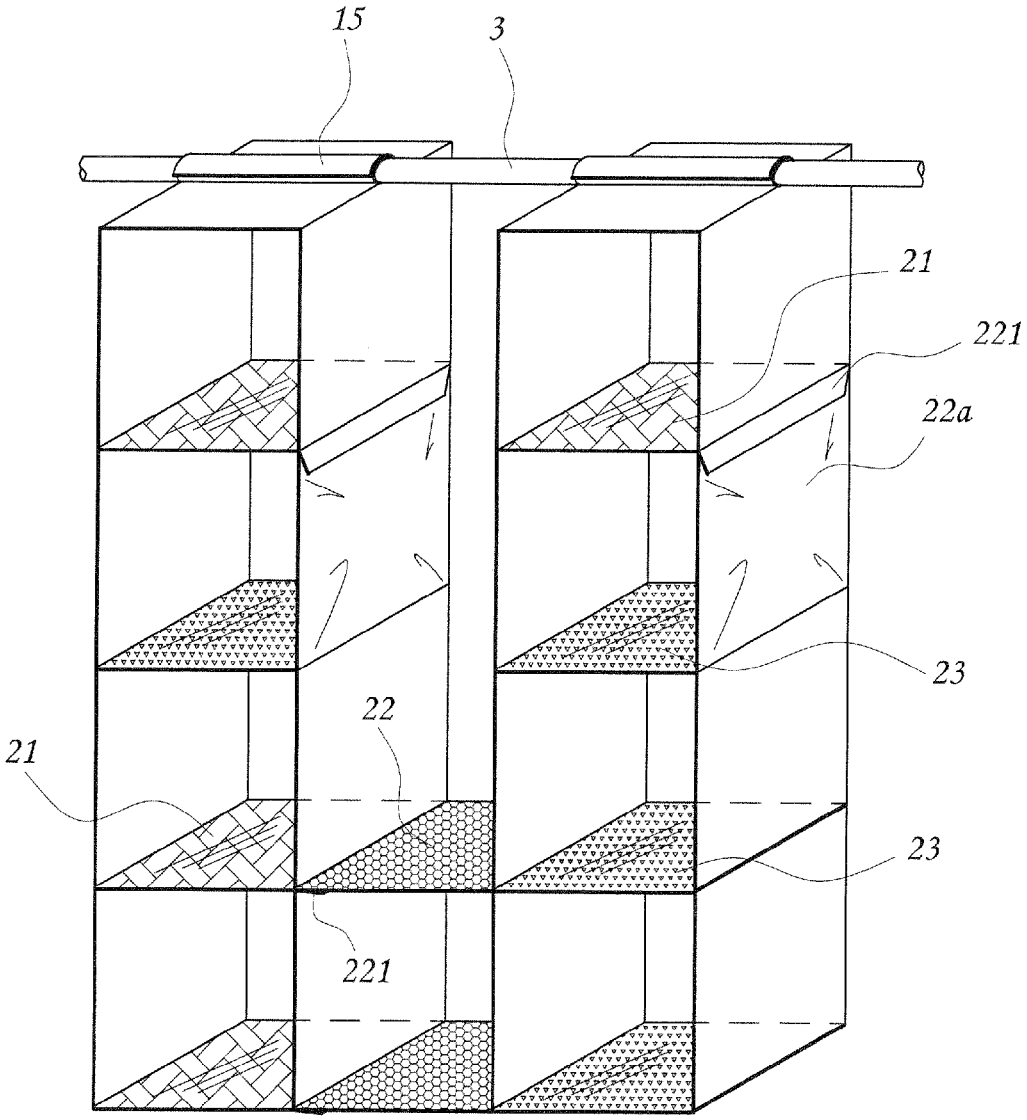
FIG. 8 illustrates another application example of the present invention.

Referring to FIG. 8 and FIGS. 2, 4 and 5 again, the closet body 1 has a sleeve 15 located on the top side thereof for hanging. A hanging rod 3 can be inserted through the sleeves 15 of the close bodies 1 of multiple hanging closets to hang multiple hanging closets in a high place. In this application example, compartment support members 2 can be selectively arranged in a flat condition or ⊏-shaped configuration and then installed in the closet bodies 1 of the hanging closets. When one compartment support members 2 is arranged in a ⊏-shaped configuration, the first support panel 21 and third support panel 23 of the compartment support member 2 are respectively insertable through two adjacent splits 140 into the inside of two adjacent horizontal panels 14 of the closet body 1 of one hanging closet to support the respective horizontal panels 14 in shape. When one compartment support members 2 is arranged in a flat condition, the first support panel 21 and the third support panel 23 are respectively inserted through one respective horizontal split 140 on each of two adjacent hanging closets into the associating horizontal panels 14, and the second support panel 22 and flexible connection pocket 22*a* of the compartment support member 2 is horizontally suspending between the two adjacent hanging closets for holding things. Further, the second support panel 22 can be directly connected between the first support panel 21 and the third support panel 23 by means of the folding lines 20 without the flexible connection pocket 22*a*.

Figure 9:
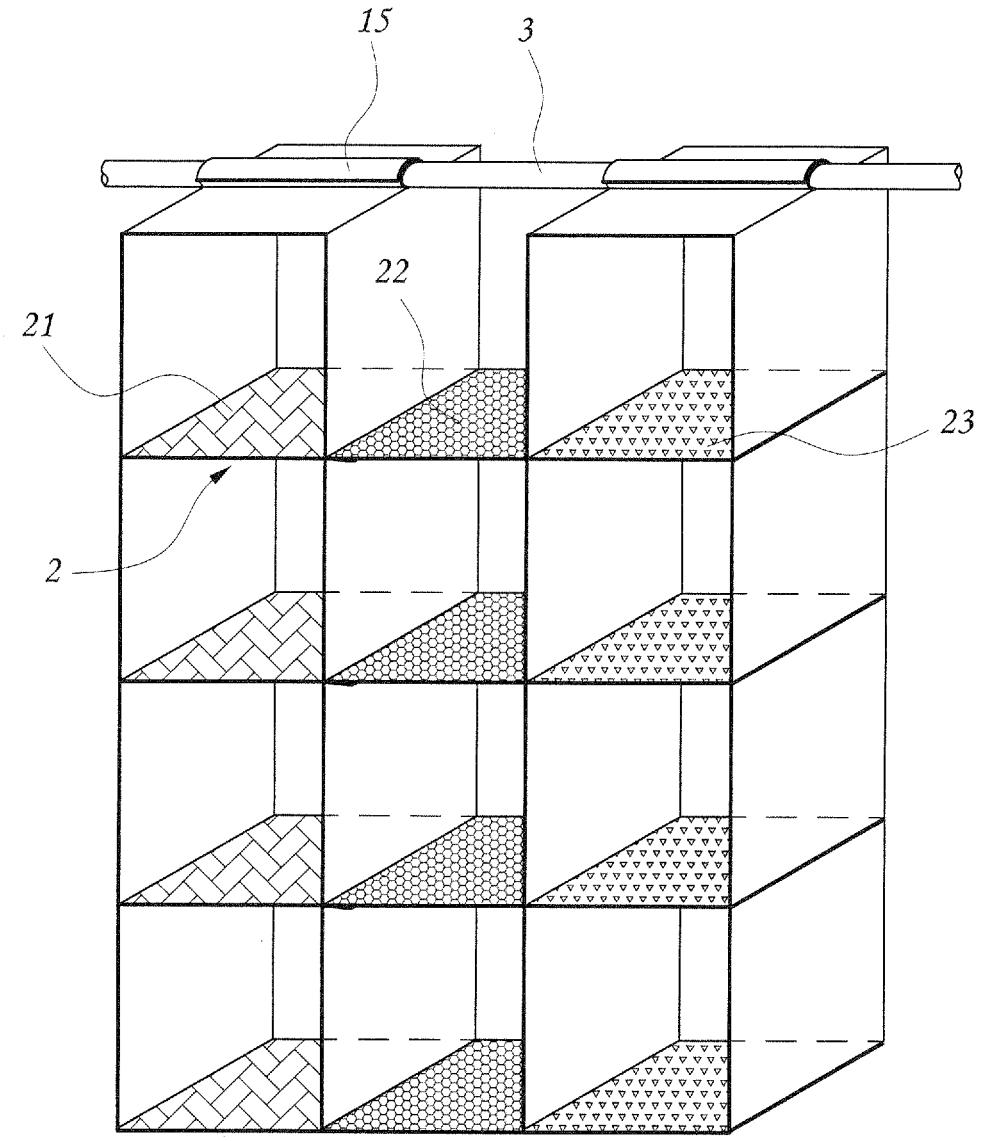
FIG. 9 illustrates still another application example of the present invention.

In the application example shown in FIG. 9, all the compartment support members 2 are arranged in a flat condition, and the first support panels 21 and third support panels 23 of the compartment support members 2 are respectively inserted through the horizontal splits 140 into the horizontal panels 14 of the closet bodies 1 of two hanging closets, and the second support panels 22 and flexible connection pockets 22*a* of the compartment support members 2 are horizontally suspending between the two hanging closets at different elevations for holding things.

Figure 10:
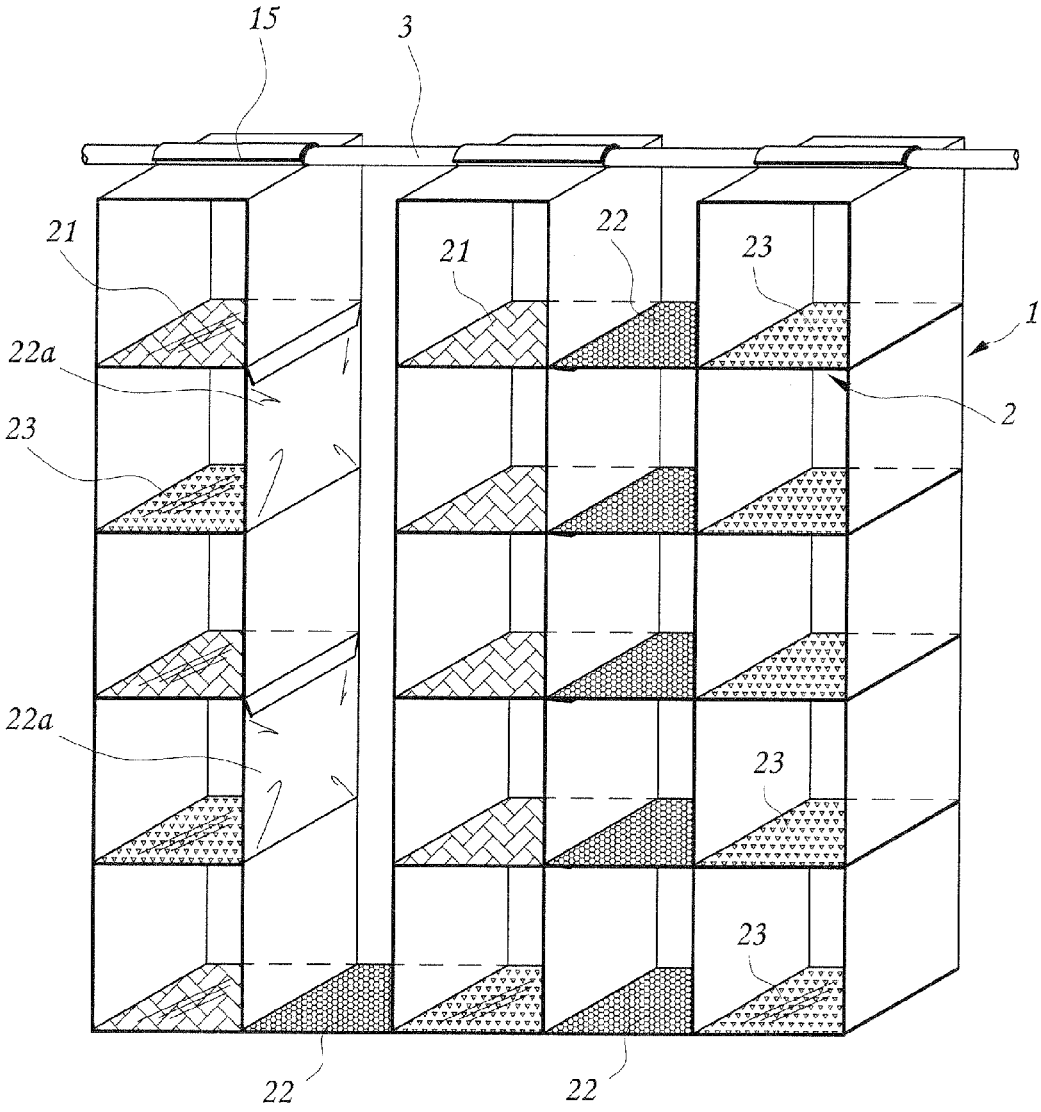
FIG. 10 illustrates still another application example of the present invention.

In the application example shown in FIG. 10, three hanging closets are hung on a hanging rod 3, and compartment support members 2 are selectively arranged in a flat condition or ⊏-shaped configuration and then installed in the closet bodies 1 of the hanging closets. According to this application example, two compartment support members 2 are horizontally mounted in the closet bodies 1 of the hanging closets on the bottom side and partially overlapped in the bottom horizontal panel 14 of the closet body 1 of the middle hanging closet.

Further, the aforesaid sleeve 15 of the closet body 1 can be formed of a strip of hook material and a strip of loop material, and the strip of hook material and the strip of loop material each have a fixed end respectively affixed to the top side of the closet body 1 and a free end detachably fastened to each other. By means of fastening the free ends of the strip of hook material and the strip of loop material together or detaching them from each other, the sleeve 15 can be conveniently fastened to or removed from the hanging rod 3 without moving the hanging rod 3 (see FIGS. 8~10).

Figure 11:
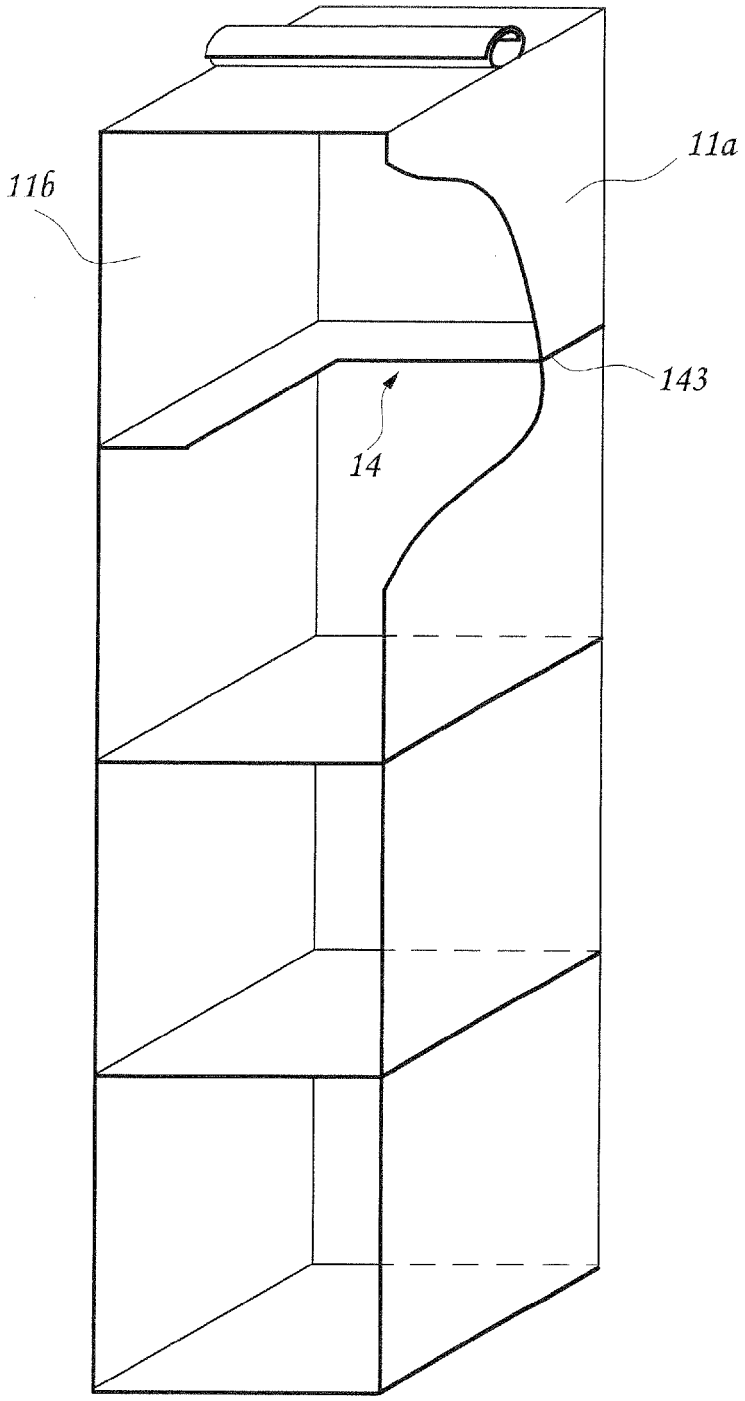
FIG. 11 is a cutaway view of still another alternate form of the closet body of the hanging closet according to the present invention.
Figure 12:
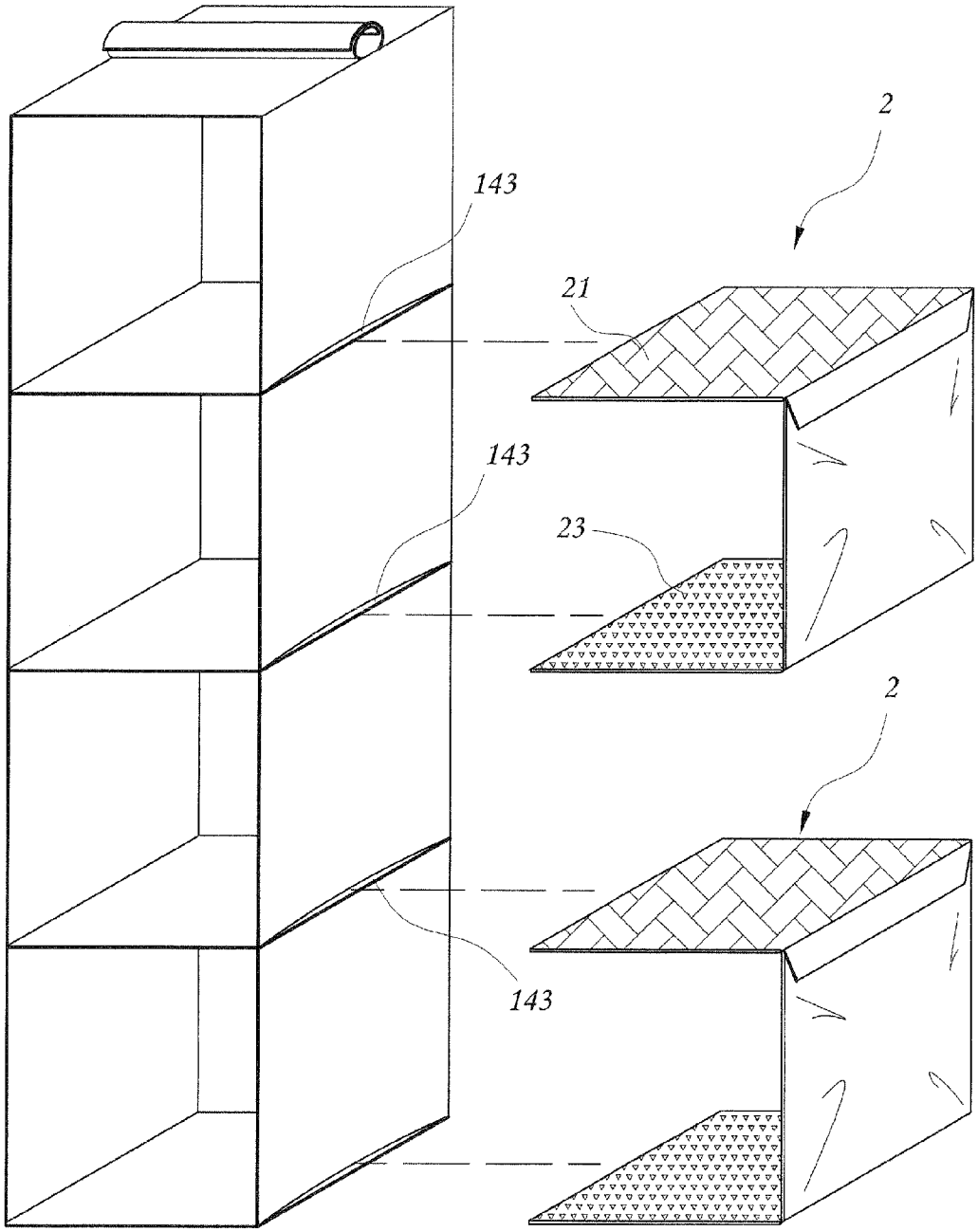
FIG. 12 is an exploded view of the present invention, illustrating an installation example of compartment support members in the hanging closet of FIG. 11.

Referring to FIGS. 11 and 12, the horizontal panels 14 of the closet body of the hanging closet can be a solid panel of a single-layer design. Further, the first side panel 11*a* and/or second side panel 11*b* has a plurality of horizontal splits 143 arranged at different elevations corresponding to the elevation of the top wall of each of the horizontal panels 14. Thus, the first support panel 21 and third support panel 23 of one compartment support member 2 can be respectively inserted through two adjacent horizontal split 143 and respectively supported on the associating horizontal panels 14.

Although particular embodiments of the invention have been described in detail for purposes of illustration, various modifications and enhancements may be made without departing from the spirit and scope of the invention. Accordingly, the invention is not to be limited except as by the appended claims.

I claim:

1. A hanging closet, comprising:

a closet body, said closet body comprising opposing first side panel and second side panel, a back panel connected between said first side panel and said second side panel, a plurality of horizontal panels joined to said first side panel, said second side panel and said back panel at different elevations and dividing the inside space of the closet body into a plurality of front-open compartments, each said horizontal panel comprising an upper panel layer and a bottom panel layer, said upper panel layer and said bottom panel layer being partially and peripherally sealed together and defining an inside space therebetween, at least one of said first side panel and said second side panel having a plurality of horizontal splits disposed at different elevations and respectively kept in communication with the inside space of each of said horizontal panels; and a plurality of compartment support members adapted for supporting said horizontal panels of said closet body in shape, each said compartment support member comprising a first support panel insertable through one horizontal split of said closet body into the inside space of one said horizontal panel, a third support panel insertable through one horizontal split of said closet body into the inside space of one said horizontal panel, a flexible connection pocket connected between said first support panel and said third support panel and having an opening at one side thereof, two folding lines respectively connected between said first support panel and said third support panel and two opposing sides of said flexible connection pocket, a cover flap connected to one said folding line and adapted for covering the opening of said flexible connection pocket, and a second support panel insertable through the opening of said flexible connection pocket into the inside of said flexible connection pocket.

2. The hanging closet as claimed in claim 1, wherein the first support panel and third support panel of each said compartment support member are respectively insertable through one respective horizontal split of the closet body of two hanging closets of the same design into the associating horizontal panel of each of the two hanging closets to let the flexible connection pocket and second support panel of the compartment support member be horizontally suspending between the two hanging closets.

3. The hanging closet as claimed in claim 1, wherein the first support panel and third support panel of each said compartment support member are respectively inserted through two adjacent horizontal splits of said closet into the associating horizontal panels, and the flexible connection pocket and second support panel of the compartment support member are closely attached to one of said first side panel and said second side panel in vertical between the respective two adjacent horizontal splits.

4. The hanging closet as claimed in claim 1, wherein the upper panel layer and bottom panel layer of each said horizontal panel of said closet body are made of a flexible transparent sheet material.

5. The hanging closet as claimed in claim 1, wherein each said horizontal panel comprises an upper panel layer and a bottom panel layer, said upper panel layer and said bottom panel layer being partially and peripherally sealed together and defining an inside space in therebetween for receiving one of the first support panel and third support panel of one said compartment support member.

* * * * *